US006766648B2

(12) United States Patent
Miliani et al.

(10) Patent No.: US 6,766,648 B2
(45) Date of Patent: Jul. 27, 2004

(54) ANTI-CONDENSATION DEVICE FOR A FLAME SENSOR OF A COMBUSTION CHAMBER

(75) Inventors: Alessio Miliani, Florence (IT); Andrea Signori, Pistoria (IT)

(73) Assignee: Nuovo Pignone Holdings S.p.A., Florence (IT)

( * ) Notice: Subject to any disclaimer, the term of this patent is extended or adjusted under 35 U.S.C. 154(b) by 42 days.

(21) Appl. No.: 10/245,709

(22) Filed: Sep. 18, 2002

(65) Prior Publication Data

US 2003/0054302 A1 Mar. 20, 2003

(30) Foreign Application Priority Data

Sep. 18, 2001 (IT) ..... MI2001A01948

(51) Int. Cl.[7] ..... F02C 7/00; G01J 5/48

(52) U.S. Cl. ..... 60/803; 60/39.83; 374/144; 374/208

(58) Field of Search ..... 60/803, 39.83; 374/144, 208

(56) References Cited

U.S. PATENT DOCUMENTS

| | | | | | |
|---|---|---|---|---|---|
| 4,648,711 | A | * | 3/1987 | Zachary | 356/44 |
| 4,786,188 | A | * | 11/1988 | Myhre et al. | 374/144 |
| 4,934,137 | A | * | 6/1990 | MacKay | 60/803 |
| 5,226,731 | A | * | 7/1993 | Allen | 374/144 |
| 5,421,652 | A | * | 6/1995 | Kast et al. | 374/144 |
| 6,354,733 | B2 | * | 3/2002 | Glasheen et al. | 374/131 |

* cited by examiner

*Primary Examiner*—Tae Jun Kim
(74) *Attorney, Agent, or Firm*—Nixon & Vanderhye

(57) ABSTRACT

An anti-condensation device for a flame sensor (10) of a combustion chamber (12), wherein the sensor (10) is disposed outside the combustion chamber (12) and determines the presence of the combustion flame by means of an aperture (14) provided in a wall of the chamber (12); the device comprises at least two tubular structures (22, 24), one of which (24) surrounds the other (22) at least partially, an annular space in which air flows being provided between these two structures (22, 24).

3 Claims, 2 Drawing Sheets

ANTI-CONDENSATION DEVICE FOR A FLAME SENSOR OF A COMBUSTION CHAMBER

The present invention relates to an anti-condensation device for a flame sensor of a combustion chamber. The combustion in combustion chambers is controlled by means of devices which can check for the presence or absence of the flame.

If in fact the flame is extinguished, the fuel is not burnt and accumulates with the risk of dangerous unforeseen explosions.

For this reason, when the flame disappears, it is necessary to close the fuel distribution valves immediately.

The importance is therefore apparent of these devices for combustion chambers in general, and in particular for gas turbine combustion chambers.

The presence of the flame is checked by means of instruments which are sensitive to rays, such as infrared or ultraviolet rays.

The output signal of these sensors can be either of the analogue type, for example electric current intensity proportional to the flame intensity, or it can be of the digital type, which indicates simply the presence or absence of the flame.

In certain conditions of use of the combustion chamber, it is possible for condensation water to form in contact with the walls of the flame sensor. This is the result of combinations of humidity from the atmosphere, pressure and temperature of the air which assists combustion at the intake of the combustion chamber, and temperature of the surfaces of the sensor itself.

This water causes attenuation of the signal generated by the sensor, and, in extreme cases, complete disappearance of the signal which is consequently seriously to the detriment of the reliability of the control device.

The object of the present invention is thus to eliminate the above-described disadvantages and in particular to provide an anti-condensation device for a flame sensor of a combustion chamber which makes the signal reliable in all conditions of use of the combustion chamber.

Another object of the invention is to provide an anti-condensation device for a flame sensor of a combustion chamber which is particularly simple and functional, and at relatively low costs.

This object and others according to the invention are achieved by providing an anti-condensation device for a flame sensor of a combustion chamber as specified in claim 1.

Further characteristics are described in the subsequent claims.

Advantageously, the anti-condensation device for a flame sensor of a combustion chamber according to the invention can also be installed on flame sensors which are already in use.

Figure 1:
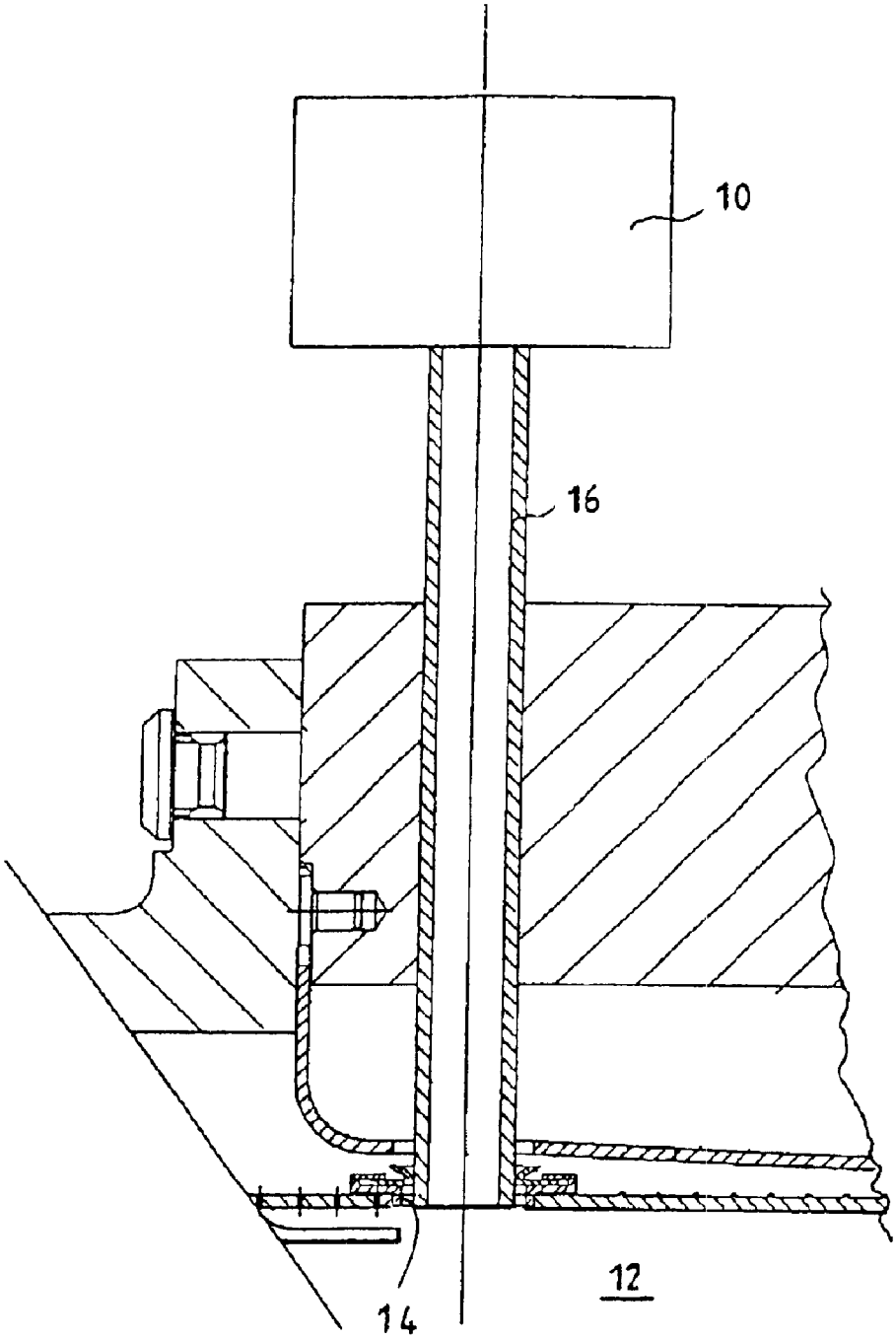
Fig.1 PRIOR ART
Figure 2:
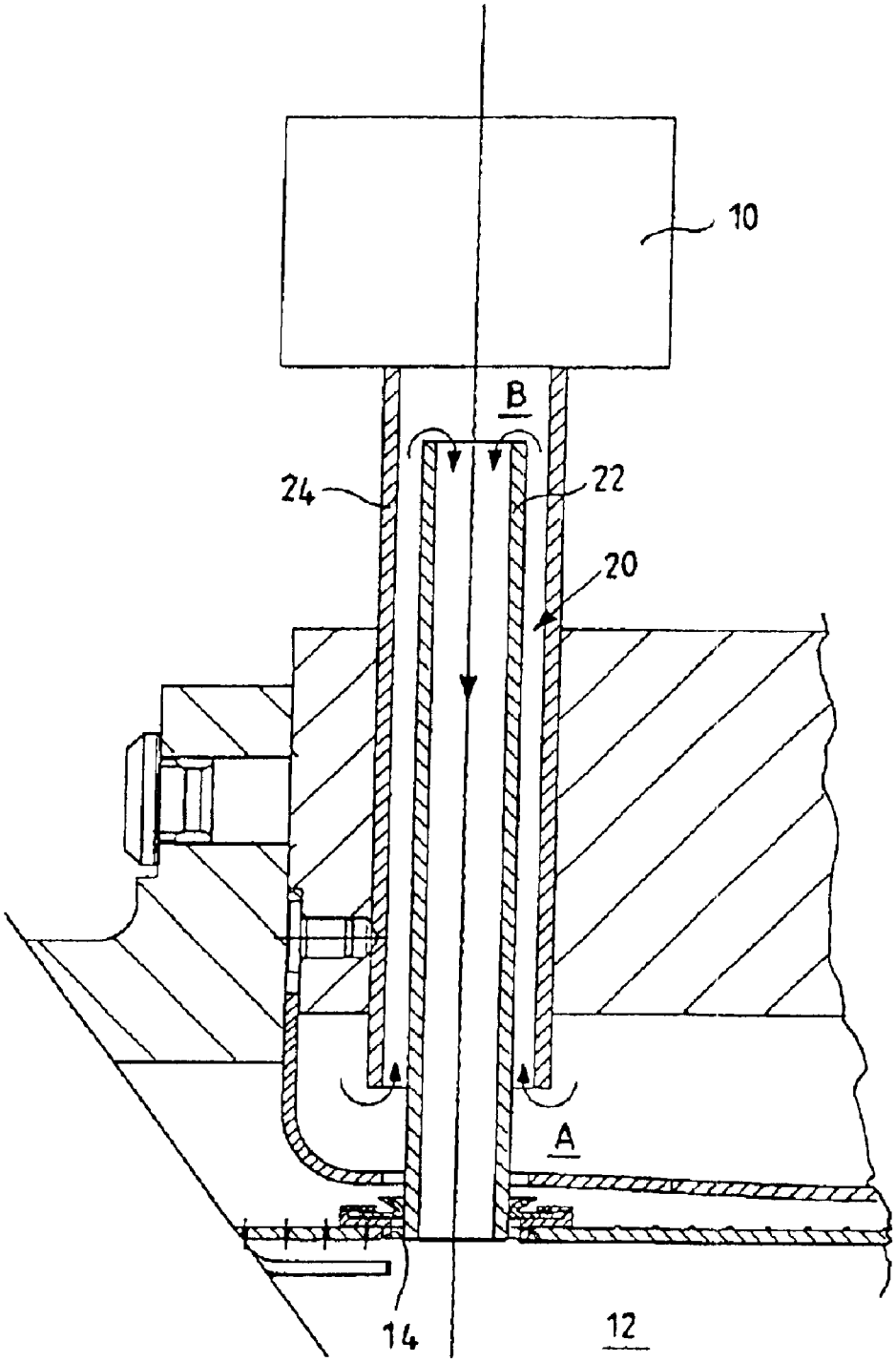

The characteristics and advantages of an anti-condensation device for a flame sensor of a combustion chamber according to the present invention will become more apparent from the following description provided by way of non-limiting example, with reference to the attached schematic drawings, in which:

FIG. 1 is a view in cross-section of a flame sensor fitted outside the combustion chamber, according to the known art; and FIG. 2 is a view in cross-section of a flame sensor fitted outside the combustion chamber, in which an anti-condensation device according to the present invention is used.

The figures show a flame sensor, indicated as 10, fitted outside a combustion chamber 12.

The chamber 12 has an aperture 14 which is connected to the sensor 10, according to the known art shown in FIG. 1, via a tubular structure 16, which for example has a circular cross-section.

In FIG. 2, the sensor 10 is connected to the aperture 14 by an anti-condensation device according to the invention which is indicated as 20 as a whole, and replaces the tubular structure 16 according to the known art.

The device 20 comprises an inner tubular structure 22, which for example has a circular cross-section, is connected to the aperture 14 of the combustion chamber 12, and extends towards the sensor 10, and an outer tubular structure 24, which for example has a circular cross-section, is connected to the flame sensor 10, and surrounds most of the length of the first structure coaxially, with the exception of an area indicated as A, in the vicinity of the aperture 14, and an area indicated as B, in the vicinity of the sensor 10.

The functioning of the anti-condensation device for a flame sensor according to the invention for a combustion chamber is clear from the foregoing description provided with reference to the figures, and briefly is as follows.

Since there is always a pressure jump between the inside and the outside of the combustion chamber 12, and specifically the external pressure is greater than the internal pressure, this situation is used in order to create circulation of air which prevents the formation of condensation water.

With reference to FIG. 2, it can be seen that the air is forced to circulate continually, by entering from the exterior of the combustion chamber 12 into the device 20 from area A, passing into a space between the inner tubular structure 22 and the outer structure 24, reaching area B, from where it flows internally to the inner structure 22, until it reaches the interior of the combustion chamber 12.

It should be noted that it is necessary to determine the dimensions of the two tubular structures 22 and 24 experimentally in order to obtain a flow of air which is correct for the required purpose.

In fact, if the air is insufficient, it does not prevent formation of the condensation, whereas excess air can cause excessive heating of the flame sensor 10. The description provided makes apparent the characteristics of the anti-condensation device which is the subject of the present invention, for a flame sensor of a combustion chamber, and also makes apparent the corresponding advantages, which it will be remembered include:

simple and reliable use;

possibility of installing the device also on existing flame sensors;

costs which are low compared with the known art.

Finally, it is apparent that many modifications and variations can be made to the anti-condensation device thus designed for a flame sensor of a combustion chamber, all of which come within the scope of the invention; in addition, all the details can be replaced by technically equivalent elements. In practice any materials, forms and dimensions can be used according to the technical requirements.

The scope of protection of the invention is thus delimited by the attached claims.

What is claimed is:

1. An anti-condensation device for a sensing apparatus in a turbine comprising:

a wall in part defining a combustion chamber;

a flame sensor body disposed outside said combustion chamber wall for determining the presence of a combustion flame; said flame sensing body having a line of sight through an aperture in the wall of the combustion chamber;

said device including first and second tubular structures with said second tubular structure at least partially surrounding said first tubular structure and defining a space therebetween for flowing air;

said first tubular structure being connected to said combustion chamber wall about said aperture and in communication with said aperture in the combustion chamber wall, said first tubular structure extending from about said aperture toward said sensor body and terminating short thereof, said second tubular structure being connected to the flame sensor body and surrounding said first tubular structure along a majority of its length terminating short of and adjacent to said aperture;

said second tubular structure enabling air to flow into said space between said first and second tubular structures at a location adjacent said aperture and in a direction toward said sensor body and reverse flow from said space into said first tubular structure for flow through the aperture and combustion wall into the combustion chamber.

2. A device according to claim 1 wherein said tubular structures are coaxial and have a development which is straight in the direction of a flame present in the combustion chamber.

3. A device according to claim 1 wherein said tubular structures are circular in cross-section and said space comprises an annulus therebetween.

* * * * *